US005375761A

United States Patent [19]

Sullivan et al.

[11] Patent Number: 5,375,761

[45] Date of Patent: Dec. 27, 1994

[54] PIZZA BOX AND METHOD OF DISPOSING OF USED PIZZA BOXES

[76] Inventors: Laura C. Sullivan; Constance B. Sullivan; Timothy J. Sullivan, all of 1443 S. Norfolk Ave., Tulsa, Okla. 74120

[21] Appl. No.: 8,717

[22] Filed: Jan. 22, 1993

[51] Int. Cl.[5] ..... B65D 5/20

[52] U.S. Cl. ..... 229/100; 229/117.01; 229/235

[58] Field of Search ..... 229/235, 103, 238, 101, 229/100, 117.01

[56] References Cited

U.S. PATENT DOCUMENTS

| | | | |
|---|---|---|---|
| 1,652,746 | 12/1927 | Terwilliger et al. . | |
| 2,706,076 | 4/1955 | Guyer . | |
| 3,167,237 | 1/1965 | Negus et al. | 229/238 |
| 3,263,807 | 8/1966 | Fingerhut | 206/65 |
| 3,642,273 | 2/1972 | Baglio | 271/61 |
| 4,008,849 | 2/1977 | Baber | 229/235 X |
| 4,113,100 | 9/1978 | Soja et al. | 229/235 X |
| 4,360,107 | 11/1982 | Roccaforte | 206/626 |
| 4,558,785 | 12/1985 | Gordon | 206/617 |
| 4,746,010 | 5/1988 | Fournier | 206/45.14 |
| 4,778,057 | 10/1988 | Allen et al. | 206/602 |
| 4,784,271 | 11/1988 | Wosaba, II et al. | 229/235 X |
| 4,804,137 | 2/1989 | Harby | 229/114 |
| 5,014,853 | 5/1991 | Crockett | 229/103 X |
| 5,110,038 | 5/1992 | Pantisano et al. | 229/103 |

*Primary Examiner*—Allan N. Shoap
*Assistant Examiner*—Christopher McDonald
*Attorney, Agent, or Firm*—Armstrong, Teasdale, Schlafly & Davis

[57] ABSTRACT

A pizza box adapted to be broken down after use into pieces to facilitate disposal having top and bottom panels, each having front, rear, left side, and right side edges, a rear panel hingedly connecting the top and bottom panels together at their rear edges, and left side, right side, and front flaps at the left side, right side, and front edges of the top and bottom panels. At least one divider strip extends across at least the top and bottom panels, for dividing the top and the bottom panels into smaller component pieces for easier disposal. According to the method of this invention a pizza box is provided having at least one divider strip extending across at least the top and bottom panels, for dividing the top and the bottom panels into smaller component pieces for easier disposal. After use the divider strip is grasped and pulled to thereby divide the top and bottom panels into smaller component pieces for easier disposal.

18 Claims, 1 Drawing Sheet

PIZZA BOX AND METHOD OF DISPOSING OF USED PIZZA BOXES

FIELD OF THE INVENTION

This invention relates to a pizza box which, after use, is adapted to be broken down into a plurality of pieces to facilitate disposal, and to a method of disposing of used pizza boxes.

BACKGROUND AND SUMMARY OF THE INVENTION

Pizza is a very popular food item, and the number of food establishments which provide home delivery of fresh, hot, pizza continues to rise. Pizza is typically delivered in large, square cardboard boxes, although sometimes the boxes may be hexagonal or octagonal. The boxes are usually made of corrugated cardboard which provides insulation to keep the pizza warm and forms strong, rigid container to protect the pizza.

While these cardboard pizza boxes function well to protect the pizza during delivery, they are difficult to dispose of after the pizza is eaten. Their large size makes it difficult to fit them in household trash containers, and their rigidity makes it difficult to fold them. Moreover, even if the box fits in the container it takes up a substantial amount of space. Because of these difficulties pizza boxes are often found hanging out of trash cans or simply left on top of to the side.

The present invention overcomes the foregoing problems by providing a pizza box which, after use, is adapted to be broken down in a plurality of manageable pieces to facilitate disposal, and a method of disposing of such pizza boxes. Generally the pizza box of the present invention comprises top and bottom panels, each having front, rear, left side, and right side edges. A rear panel hingedly connects the top and bottom panels together at their rear edges. There are left side, right side, and front flaps at the left side, right side, and front edges of the top and bottom panels, respectively. At least one divider strip extends across at least the top and bottom panels, for dividing the top and the bottom panels into smaller component pieces for easier disposal. There are preferably at least two divider strips, one extending across the top panel from one side edge to the other, and the other extending across the bottom panel from one side edge to the other. According to a first embodiment of the invention, the divider strip comprises a zip rule extending across the top and the bottom panels. The zip rule is formed by spaced parallel lines of perforations defining a strip which can be separated from its respective panel to divide the panel into pieces. According to a second embodiment of the invention, the divider strip comprises a high-strength tear strip extending across the top and the bottom panels that can be pulled through its respective panel to divide the panel into pieces.

Generally, the method of this invention comprises providing a pizza box having top and bottom panels, each having front, rear, left side, and right side edges; a rear panel hingedly connecting the top and bottom panels together at their rear edges; left side, right side, and front flaps at the left side, right side, and front edges of the top and bottom panels; and at least one divider strip extending across at least the top and bottom panels. After the pizza box is used, the divider strip is grasped and pulled to divide the top and bottom panels into smaller component pieces, which are easier to dispose of.

BRIEF DESCRIPTION OF THE DRAWINGS

In the accompanying drawings which form a part of the specification and are to be read in conjunction therewith, and in which like reference numerals are used to indicate like parts in the various views.

DETAILED DESCRIPTION OF THE PREFERRED EMBODIMENTS

Figure 1:
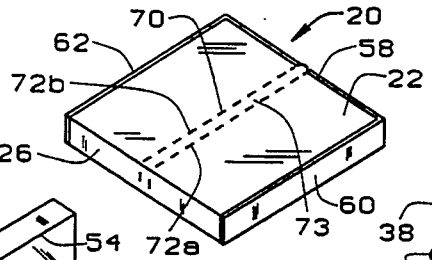
FIG. 1 is a perspective view of a first embodiment pizza box constructed according to the principles of this invention.
Figure 2:
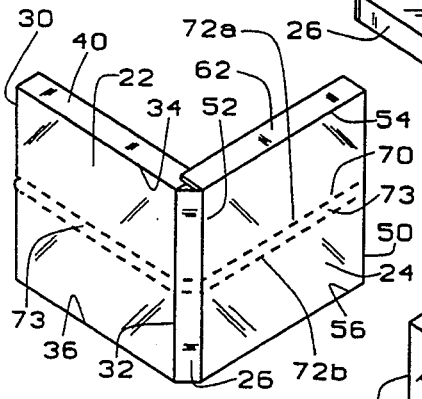
FIG. 2 is a perspective view of the pizza box of the first embodiment showing the exterior of the top, bottom, and rear panels.
Figure 3:
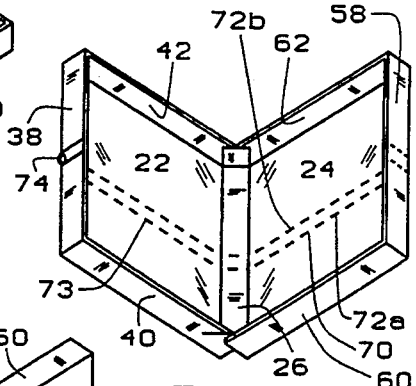
FIG. 3 is a perspective view of the pizza box of the first embodiment, showing the interior of the top, bottom, and rear panels.
Figure 4:
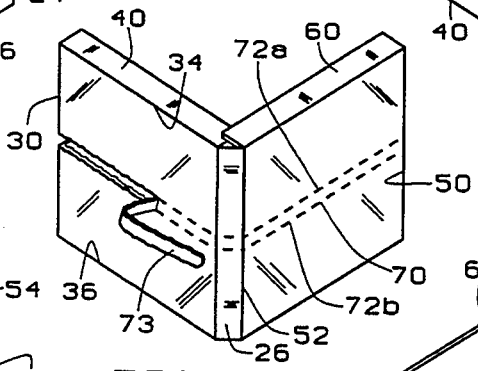
FIG. 4 is a perspective view of the pizza box of the first embodiment, similar to FIG. 2, showing the zip rule partially removed.
Figure 5:
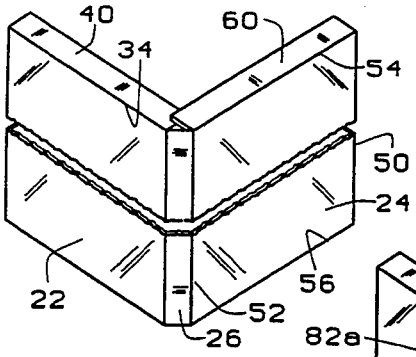
FIG. 5 is a perspective view of the pizza box of the first embodiment, similar to FIG. 2, showing the zip rule completely removed.

A first embodiment of a pizza box constructed according to the principles of this invention is indicated generally as 20 in FIGS. 1–5. The box 20 comprises a top panel 22, a bottom panel 24, and a rear panel 26.

The top panel 22 is generally square, comprising a front edge 30, a rear edge 32, a left side edge 34, and a right side edge 36. The front edge 30 of the top 22 has an integral front flap 38 depending downwardly therefrom. The left side edge 34 of the top 22 has a left side flap 40, and the right side edge 36 of the top has a right side flap 42 depending therefrom. The side flaps 40 and 42 are integral with, and depend downwardly from their respective side edges 34 and 36. The front ends of the side flaps 40 and 42 can be secured to the front flap 38.

The bottom panel 24 is generally square comprising a front edge 50, a rear edge 52, a left side edge 54, and a right side edge 56. The front edge 50 of the bottom 24 has a flap 58 integral with and extending upwardly therefrom. The left side edge 54 of the bottom 24 has a left side flap 60, and the right side edge 56 of the bottom has a right side flap 62. The left side flap 60 and the right side flap 62 are integral with, and extend upwardly from, their respective side edges 54 and 56. The front ends of the side flaps 60 and 62 can be secured to the front flap 58.

While the top and bottom panels 22 and 24 are shown as squares, they could have some other shape, such as hexagons or octagons, without departing from the principles of this invention. The rear panel 26 is hingedly connected along its top edge to the rear edge 32 of the top panel 22, and along its bottom edge to the rear edge 52 of the bottom panel 24.

The pizza box 20 includes a zip rule 70. A zip rule is a well-known construction packaging art to facilitate separating portions of cardboard and hard paper products. The zip rule 70 comprises spaced, parallel lines of perforations 72*a* and 72*b*, defining a removable strip 73 between them. The zip rule 70 in FIGS. 1–4 has a tab 74 near the front flap 38 of top 22. The zip rule 70 extends from tab 74 across top panel 22 parallel with side edges 34 and 36, across rear panel 26, across bottom panel 24 parallel with side edges 54 and 56, and across bottom front flap 58. When the zip rule 70 is completely removed, the pizza box 20 is broken down into two pieces 76 and 78. (See FIG. 5.)

In the first preferred embodiment, the tab 74 is near front flap 38 of top 24. It should be understood that tab 74 could also be located on bottom front flap 58. The pizza box 20 is preferably constructed of corrugated cardboard, and the zip rule 70 preferably extends parallel to the corrugations. It should also be understood that more than one zip rule could be provided to break the box 20 into smaller pieces. Also, as described below, the zip rule 70 could extend from side to side instead of from front to back, across the top and bottom panels 22 and 24.

Figure 6:
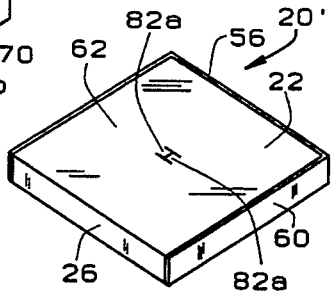
FIG. 6 is a perspective view of a second embodiment of a pizza box constructed according to the principles of this invention.
Figure 7:
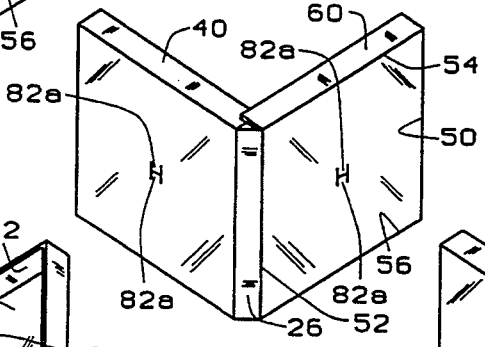
FIG. 7 is a perspective view of the pizza box of the second embodiment showing the exterior of the top, bottom, and rear panels.
Figure 8:
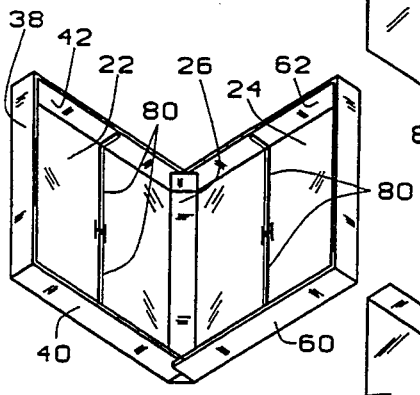
FIG. 8 is a perspective view of the pizza box of the second embodiment showing the interior of the top, bottom, and rear panels.
Figure 9:
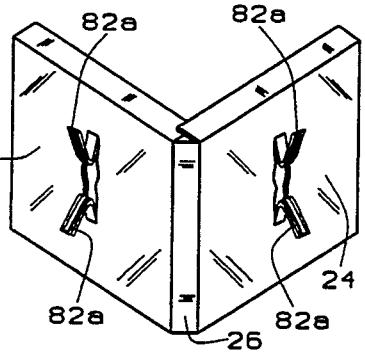
FIG. 9 is a perspective view of the pizza box of the second embodiment showing the tear strips partially removed.
Figure 10:
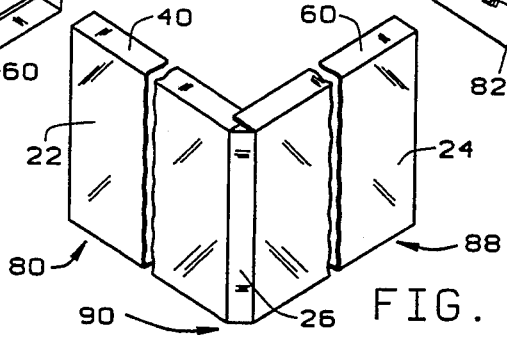
FIG. 10 is a perspective view of the pizza box of the second embodiment, showing the tear strips completely removed.

A second embodiment of a pizza box constructed according to the principles of this invention is indicated generally as 20′ in FIGS. 6–10. The pizza box 20′ is similar to box 20, with corresponding parts identified with corresponding reference numerals. However, rather than the zip rule 70 used in box 20, box 20′ employs high-strength tear strips 80. Tear strips 80 are a well-known technique in packaging art to facilitate separating portions of cardboard or hard paper products. Each tear strip 80 comprises a high-strength strip secured to a side of the cardboard or hard paper, which can be pulled through the cardboard or hard paper to tear the cardboard or hard paper along the line of the high-strength strip. As shown in the Figures, in box 20′, there are two strips 80 anchored at the centers of the side edges 40 and 42, and extend across the interior of top panel 22. Likewise there are two strips 80 anchored at the centers of the side edges 60 and 62 and extend across the interior of the bottom panel 24. The tear strips 80 secured to top panel each end near the center of the top panel on either side of an H-shaped cut 82. Similarly, the tear strips 80 secured to bottom panel 24 each end near the center of the bottom panel on either side of an H-shaped cut 82. The H-shaped cut 82 are tabs for starting each of the tear strips 80 on the top and bottom panels.

When both tear strips are completely removed from the top and bottom of the pizza box 20′, the box 20′ is broken down into three parts 86, 88, and 90, part 90 comprising the rear panel 26 and portions of top panel 22 and bottom panel 24.

The pizza box 20′ is preferably constructed of corrugated cardboard, and the tear strips 80 preferably extend perpendicular to the corrugations. While the pizza box 20′ is shown with two sets of tear strips, one set on the top 22 and the other set on the bottom 24, the pizza box 20′ could have a single set of tear strips extending across the top and bottom panels 22 and 24, as in the first embodiment shown in FIGS. 1–5.

OPERATION

In operation, after use, the pizza box 20 is firmly grasped, and tab 74 of zip rule 70 is pulled from the front flap 38 of the top panel 22, over top panel 22, across rear panel 26, across bottom panel 24, and finally across the front flap 58 of the bottom panel, separating the box 20 into two substantially equally-dimensioned pieces 76 and 78. The pieces 76 and 78 each remain hingeably attached by center panel 26. Each part 76 and 78 is folded along rear panel 26 and can be easily and conveniently disposed of in a conventional trash container.

In operation the pizza box 20′, the box 20′ is placed on a firm surface with H-cut 82 in the top panel 22 facing upwardly. The H-cut on top panel 22 is opened forming two tabs 82*a*. Each tab 82*a* is grasped firmly, one in each hand, and pulled, pulling the tear strip 80 through the panel. The pieces of tear strips 80 are pulled across top panel 22 and across top side flaps 40 and 42. This procedure is repeated with the H-cut on bottom panel 24. This breaks the box 20 into parts 86, 88, and 90. (See FIG. 10.) The center part 90 is folded along rear panel 26. The three resulting parts of box 20 are now of similar size and easily discarded in a conventional trash container.

The foregoing demonstrates that this invention is well adapted to obtain the objects set forth together with the other advantages which are obvious and which are inherent to the structure and method. Although illustrated embodiments of the present invention are described herein with reference to the accompanying drawings, it is to be understood that the invention is not limited to those precise embodiments and that various other changes and modifications may be effective therein by one skilled in the art without departing from the scope or spirit of the invention.

What is claimed is:

1. A pizza box adapted to be broken down after use into pieces to facilitate disposal, the pizza box comprising top and bottom panels, each having front, rear, left side, and right side edges;

a rear panel hingedly connecting the top and bottom panels together at their rear edges, the top and bottom panels being unconnected at the sides and the front to form a reclosable opening at the sides an the front so that the top panel can be pivoted about its rear edge to open the pizza box and allow access to the interior of the pizza box;

left side, right side, and front flaps at the left side, right side, and front edges of at least one of the top and bottom panels; and at least one divider strip extending across at least the top and bottom panels, which cooperates with the reclosable opening for dividing the top and bottom panels into smaller component pieces for easier disposal, the divider strip including a zip rule extending across the top and the bottom panels, formed by spaced parallel lines of perforations defining a strip which can be separated from its respective panel to divide the panel into pieces.

2. The pizza box according to claim 1 wherein the pizza box is constructed of corrugated cardboard and the zip rule extends parallel to the corrugation.

3. The pizza box according to claim 1 wherein there are at least two zip rules, one zip rule extending across the top panel from one side edge to the other, and the other zip rule extending across the bottom panel from one side edge to the other.

4. The pizza box according to claim 1 wherein each zip rule has an H-cut generally at its center separating the zip rule into two halves and providing a starting point for separating each half from the panel.

5. The pizza box according to claim 1 wherein the divider strip comprises a high-strength tear strip extending across the top and the bottom panels that can be pulled through its respective panel to divide the panel into pieces.

6. The pizza box according to claim 5 wherein the pizza box is constructed of corrugated cardboard and the tear strip extends perpendicular to the corrugation.

7. The pizza box according to claim 5 wherein there are at least two high strength tear strips, one tear strip extending across the top panel from one side edge to the other, and the other tear strip extending across the bottom panel from one side edge to the other.

8. The pizza box according to claim 1 wherein the divider strip comprises two aligned high-strength tear strips extending across the top and bottom panels, and an H-cut separating the two strips and providing a starting point for pulling the tear strips through their respective panels to divide the panel into pieces.

9. The pizza box according to claim 1 wherein there are at least two divider strips, one divider strip extending across the top panel from one side edge to the other, and the other divider strip extending across the bottom panel from one side edge to the other.

10. An improved pizza box of the type comprising top and bottom panels, each having front, rear, left side, and right side edges; a rear panel hingedly connecting the top and bottom panels together at their rear edges, the top and bottom panels being unconnected at the sides and front, so that the top panel can be pivoted about its rear edge to open the pizza box to allow access to the interior of the pizza box; the improvement comprising at least one divider strip extending across at least the top and bottom panels, separate from, but cooperating with the reclosable opening, for dividing the top and the bottom panels into smaller component pieces for easier disposal, the divider strip including a zip rule extending across the top and the bottom panels, formed by spaced parallel lines of perforations defining a strip which can be separated from its respective panel to divide the panel into pieces.

11. The improved pizza box according to claim 10 wherein the pizza box is constructed of corrugated cardboard and the zip rule extends parallel to the corrugation.

12. The improved pizza box according to claim 10 wherein there are at least two zip rules, one zip rule extending across the top panel from one side edge to the other, and the other zip rule extending across the bottom panel from one side edge to the other.

13. The improved pizza box according to claim 10 wherein each zip rule has an H-cut generally at its center separating the zip rule into two halves and providing a starting point for separating each half from the panel.

14. The improved pizza box according to claim 10 wherein the divider strip comprises a high-strength tear strip extending across the top and bottom panels that can be pulled through its respective panel to divide the panel into pieces.

15. The improved pizza box according to claim 14 wherein the pizza box is constructed of corrugated cardboard and the tear strip extends perpendicular to the corrugation.

16. The improved pizza box according to claim 14 wherein there are at least two high strength tear strips, one tear strip extending across the top panel from one side edge to the other, and the other tear strip extending across the bottom panel from one side edge to the other.

17. The pizza box according to claim 10 wherein the divider strip comprises two aligned high-strength tear strips extending across the top and bottom panels, and an H-cut separating the two strips and providing a starting point for pulling the tear strips through their respective panels to divide the panel into pieces.

18. The improved pizza box according to claim 10 wherein there are at least two divider strips, one divider strip extending across the top panel from one side edge to the other, and the other divider strip extending across the bottom panel from one side edge to the other.

* * * * *